US009027443B2

(12) United States Patent
Zhuk et al.

(10) Patent No.: US 9,027,443 B2
(45) Date of Patent: May 12, 2015

(54) METHOD OF MAKING A RAZOR

(75) Inventors: Andrew Zhuk, Acton, MA (US); Weili Yu, Medfield, MA (US); Hoang Mai Trankiem, Boston, MA (US); Neville Sonnenberg, Newton, MA (US); Kevin Leslie Powell, Reading (GB); Yiqian Eric Liu, Lexington, MA (US); Robert L. Lescanec, Boston, MA (US); Steve S. Hahn, Wellesley, MA (US); Joseph Allan DePuydt, Quincy, MA (US); Cinzia Simonis de Cloke, Arlington, MA (US); Alan Crook, Hampshire (GB)

(73) Assignee: The Gillette Company, Boston, MA (US)

( * ) Notice: Subject to any disclaimer, the term of this patent is extended or adjusted under 35 U.S.C. 154(b) by 935 days.

(21) Appl. No.: 12/951,111

(22) Filed: Nov. 22, 2010

(65) Prior Publication Data

US 2011/0120973 A1 May 26, 2011

Related U.S. Application Data

(62) Division of application No. 11/392,127, filed on Mar. 29, 2006, now Pat. No. 7,882,640.

(51) Int. Cl.

| | |
|---|---|
| ***B26B 21/60*** | (2006.01) |
| ***B26B 21/22*** | (2006.01) |
| ***B05D 5/00*** | (2006.01) |

(Continued)

(52) U.S. Cl.

CPC ..... *B26B 21/222* (2013.01); *B05D 5/083* (2013.01); *B05D 7/14* (2013.01); *B26B 21/60* (2013.01); *Y10S 76/08* (2013.01)

(58) Field of Classification Search

CPC ..... B26B 21/222; B26B 21/60; Y10S 76/08
USPC ..... 30/34.2, 50, 346.5, 346.53–346.56; 76/DIG. 8, 104.1

See application file for complete search history.

(56) References Cited

U.S. PATENT DOCUMENTS

| | | | |
|---|---|---|---|
| 1,579,844 | A | 4/1926 | Smith |
| 3,777,396 | A | 12/1973 | Simonetti |
| 3,834,017 | A | 9/1974 | Tolmie |

(Continued)

FOREIGN PATENT DOCUMENTS

| | | | |
|---|---|---|---|
| DE | 853397 | A | 2/1952 |
| EP | 0 191 203 | A2 | 8/1986 |

(Continued)

OTHER PUBLICATIONS

PCT International Search Report dated Aug. 21, 2007.

(Continued)

*Primary Examiner* — Clark F Dexter
(74) *Attorney, Agent, or Firm* — Kevin C. Johnson; Steven W. Miller

(57) ABSTRACT

Razors are described herein. In some instances the razors include a safety razor blade unit that includes a guard, a cap, and at least two blades with parallel sharpened edges located between the guard and cap. A first blade defines a blade edge nearer the guard and a second blade defines a blade edge nearer the cap. The first blade has a cutter force greater than the cutter force of the second blade. In some instances the razors provide a comfortable shave having improved closeness.

15 Claims, 6 Drawing Sheets

(51) Int. Cl.
*B05D 7/14* (2006.01)
*B05D 5/08* (2006.01)

(56) References Cited

U.S. PATENT DOCUMENTS

| | | | |
|---|---|---|---|
| 3,834,947 | A | 9/1974 | Swoboda et al. |
| 3,871,073 | A | 3/1975 | Nissen et al. |
| 3,911,579 | A | 10/1975 | Lane et al. |
| 3,934,338 | A | 1/1976 | Braginetz |
| 3,949,470 | A | 4/1976 | Hall |
| 4,044,463 | A | 8/1977 | Tietjens |
| 4,167,662 | A | 9/1979 | Steen |
| 4,304,978 | A | 12/1981 | Saunders |
| 4,473,735 | A | 9/1984 | Steffen |
| 4,507,538 | A | 3/1985 | Brown et al. |
| 4,980,021 | A | 12/1990 | Kitamura et al. |
| 4,998,347 | A | 3/1991 | Schachter |
| 5,263,256 | A | 11/1993 | Trankiem |
| 5,347,887 | A | 9/1994 | Rosenthal et al. |
| 5,360,495 | A | 11/1994 | Schuler et al. |
| 5,488,774 | A | 2/1996 | Janowski |
| 5,522,137 | A | 6/1996 | Andrews |
| 5,532,495 | A | 7/1996 | Bloomquist et al. |
| 5,546,660 | A | 8/1996 | Burout et al. |
| 5,575,185 | A | 11/1996 | Cox et al. |
| 5,630,275 | A | 5/1997 | Wexler |
| 5,661,907 | A | 9/1997 | Apprille |
| 5,906,053 | A | 5/1999 | Turner et al. |
| 6,055,731 | A | 5/2000 | Zucker |
| 6,077,572 | A | 6/2000 | Hopwood et al. |
| 6,082,007 | A | 7/2000 | Andrews |
| 6,156,435 | A | 12/2000 | Gleason et al. |
| 6,161,287 | A | 12/2000 | Swanson et al. |
| 6,161,288 | A | 12/2000 | Andrews |
| 6,178,852 | B1 | 1/2001 | Pfaff |
| 6,212,777 | B1 | 4/2001 | Gilder et al. |
| 6,216,349 | B1 | 4/2001 | Gilder et al. |
| 6,243,951 | B1 | 6/2001 | Oldroyd |
| 6,289,593 | B1 | 9/2001 | Decker et al. |
| 6,295,734 | B1 | 10/2001 | Gilder et al. |
| 6,335,506 | B2 | 1/2002 | Christmas et al. |
| 6,353,204 | B1 | 3/2002 | Spaay et al. |
| 6,442,840 | B2 | 9/2002 | Zucker |
| 6,468,642 | B1 | 10/2002 | Bray et al. |
| 6,511,559 | B2 | 1/2003 | Brenner et al. |
| 6,534,131 | B1 | 3/2003 | Domoto et al. |
| 6,612,204 | B1 | 9/2003 | Droese et al. |
| 7,047,646 | B2 | 5/2006 | Coffin |
| 7,060,367 | B2 | 6/2006 | Yamada et al. |
| 2001/0013174 | A1 | 8/2001 | Zucker |
| 2001/0015348 | A1 | 8/2001 | Christmas et al. |
| 2002/0066186 | A1 | 6/2002 | White et al. |
| 2002/0100522 | A1 | 8/2002 | Benton et al. |
| 2003/0094077 | A1 | 5/2003 | Hoffman |

FOREIGN PATENT DOCUMENTS

| | | | |
|---|---|---|---|
| EP | 0 640 693 | A1 | 3/1995 |
| EP | 0 850 126 | B1 | 1/2001 |
| JP | 60165319 | | 8/1985 |
| JP | 60258416 | | 12/1985 |
| JP | 04263020 | | 9/1992 |
| WO | WO 94/26476 | A | 11/1994 |

OTHER PUBLICATIONS

Report No. 3709/10024, O. D. Oglesby, 'Extending Hairs With Controlled Forces', 15 Pages, 8 Figures, 1 Table, 6 Plates, date unknown.
Report No. 3677/10024, O. D. Oglesby, 'Beard Hair Response to Applied Forces', 27 Pages, 11 Figures, 3 Tables, 3 Plates, dated Apr. 12, 1995.

84

METHOD OF MAKING A RAZOR

CROSS REFERENCE TO RELATED APPLICATION(S)

This application is a divisional of U.S. application Ser. No. 11/392,127, filed on Mar. 29, 2006, now U.S. Pat. No. 7,882,640, the disclosure of which is hereby incorporated herein by reference in its entirety.

TECHNICAL FIELD

This invention relates to razor blades.

BACKGROUND

In shaving, it is desirable to achieve a close shave, while also providing good shaving comfort. Factors that affect shaving performance include the frictional resistance between the blade edge and the skin, the cutter force applied by the blade to the hair.

It is common for razor blades used for wet shaving to include a thin polymer coating on the blade edge, which can reduce the frictional resistance between the blade edge and the skin and thereby reduce the cutter force of the blade, greatly improving shaving comfort. Such coatings are described, for example, in U.S. Pat. No. 5,263,256 to Trankiem, the entire disclosure of which is incorporated by reference herein. The polymer coating also helps the blade glide smoothly along the surface of the skin, potentially managing the skin bulge as the razor is pulled along the user's skin.

SUMMARY

One method of improving the closeness of a shave is to increase the engagement time of a razor blade with a hair, and thereby improve the ability of the razor blade to pull hair out of the follicle. This can be accomplished by modifying the surface of the blade to provide a blade having increased frictional resistance and increased cutter forces. Cutter force is measured by the wool felt cutter test, which measures the cutter forces of the blade by measuring the force required by each blade to cut through wool felt. The cutter force of each blade is determined by measuring the force required by each blade to cut through wool felt. Each blade is run through the wool felt cutter 5 times and the force of each cut is measured on a recorder. The lowest of 5 cuts is defined as the cutter force.

Where a razor has multiple blades, one or more blades can be designed for increased time of engagement with hair, for example by having a higher frictional resistance, while other blades can be designed to reduce cutter forces and improve comfort, for example using a polymer coating such as those described in U.S. Pat. No. 5,263,256. This combination of different blades having differing frictional resistances, in some instances, provides a shave having improved closeness while maintaining comfort.

In general, in some aspects, the invention features a razor including a safety razor blade unit that includes a guard, a cap, and at least two blades with parallel sharpened edges located between the guard and cap. A first blade defining a blade edge is positioned nearer the guard and a second blade defining a blade edge is positioned nearer the cap.

In one such aspect, the first blade has a cutter force greater than the cutter force of the second blade.

In another such aspect, the second blade is coated with a greater amount of a polymer composition than the first blade.

In a further aspect, the first and second blades comprise a polymer coating and the polymer coating on the first blade is less lubricious than the polymer coating on the second blade.

Some implementations include one or more of the following features. The first blade may have a cutter force at least about 0.1 lbs. greater, e.g., at least about 0.2 lbs greater, than the cutter force of the second blade. For example, the first blade may have a cutter force from about 0.1 lbs. to about 1.0 lbs. greater, preferably about 0.1 to 0.5 lbs greater, than the second blade. The cutter force of the first blade may be between about 1.2 lbs and 1.5 lbs. The blades may be coated with a polymer composition, e.g., a polyfluorocarbon such as polytetrafluoroethylene. The second blade may be coated with a greater amount of polymer composition than the first blade. The first blade and the second blade may be coated with different polymer compositions. For example, the polymer composition coating the first blade may be less lubricious than the polymer composition coating the second blade. In some cases, the first blade may be substantially free of polymer coating.

The invention also features methods of treating a razor blade.

For example, the invention features a method including disposing a polymer coating on a razor blade, and exposing the coated razor blade to plasma, laser, or electric current, thereby modifying at least a portion of the polymer coating.

The invention also features methods of making razors that include a safety razor blade unit comprising a guard, a cap, and at least two blades having parallel sharpened edges located between the guard and cap, a first blade defining a blade edge nearer the guard and a second blade defining a blade edge nearer the cap. One such method includes treating the first or second blade to provide the second blade with a lower cutter force than the first blade.

The invention further features methods of shaving. One such method includes (a) providing a safety razor blade unit comprising a guard, a cap, and at least two blades with parallel sharpened edges located between the guard and cap, a first blade defining a blade edge nearer the guard and a second blade defining a blade edge nearer the cap, in which the first blade has a cutter force greater than the cutter force of the second blade and/or the second blade is coated with a greater amount of a polymer composition than the first blade; and (b) contacting a skin surface with the safety razor blade unit.

In other aspects, the invention features razors including the blade units described herein.

In some instances, the razors described herein provide a shave having improved closeness relative to a control razor, e.g., a similar razor in which all of the blades have substantially the same frictional resistance. In some instances, the razors described herein provide greater shaving efficiency relative to the control razor, increasing the number of hairs cut per unit stroke.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1A:
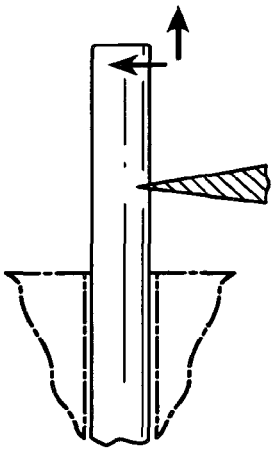
FIGS. 1*a-c* represent a schematic diagram depicting the cutting of a hair extended from a hair follicle.
Figure 1B:
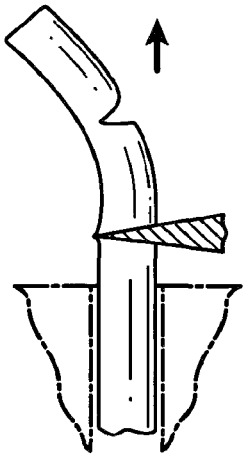
Figure 1C:
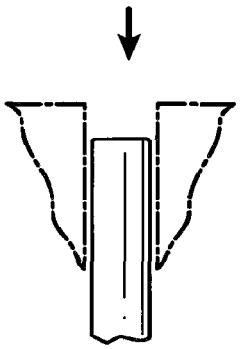

Pulling a hair prior to cutting it with a razor can result in a close shave of that hair. In the case of a multiblade razor a first blade can be used to pull the hair away from the follicle and cut the hair to a first length while a second blade, positioned behind the first blade, can cut the hair to a second, shorter length. Referring to FIG. 1, a hair is pulled in both an upward and forward direction by a first blade. While the hair is in this position, it will be cut by the first blade to a first length. The hair will retreat into the follicle relatively slowly, and thus while the hair remains extended from the follicle, the second blade is able to cut the hair to a second, shorter length. Upon relaxation, the cut hair settles below the surface of the skin to provide a close shave and a smooth feel to the user's skin.

Razors Having Blades with Varied Frictional Resistance

Figure 2:
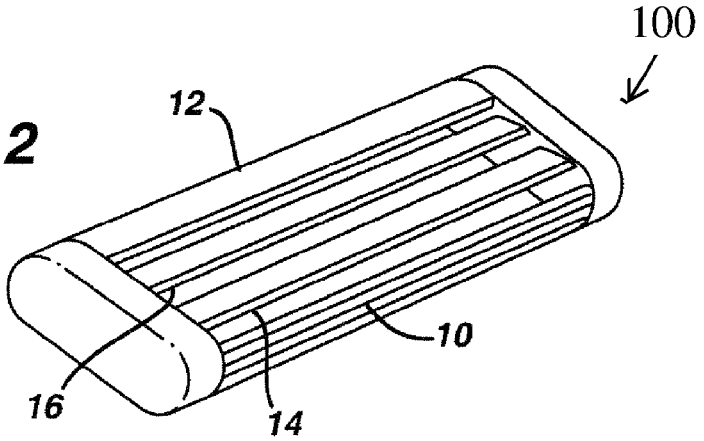
FIGS. 2, 3*a-b*, 4, and 5*a-c* depict razors having multiple blades where one or more blades have relatively higher cutter forces than another blade positioned in the razor.

Referring to FIG. 2, a razor cartridge 100 includes a guard 10, a cap 12, and two blades 14 and 16. The first blade 14 has higher cutter forces than the second blade 16, and is positioned between the guard and the second blade. Thus, when the razor is in use, the first blade 14 will contact the hair before the second blade 16. As the first blade 14 passes the user's skin, it engages a hair, pulling it and thereby extending the hair outside of the hair follicle, and cutting the hair to a first length. Before the hair has retracted fully back into its original position, the second blade 16 passes the user's skin and it cuts the hair again, to a shorter length. Subsequent to cutting, the hair settles back into the hair follicle below the surface of the skin.

As used herein in both the text and the figures the term "first blade" refers to a blade having relatively higher cutter forces, which correspond to a higher frictional resistance than the blade referred to as the second blade. Likewise, the term second blade refers to a blade having relatively lower cutter forces, which correspond to a lower frictional resistance than the blade referred to as the first blade.

Figure 3A:
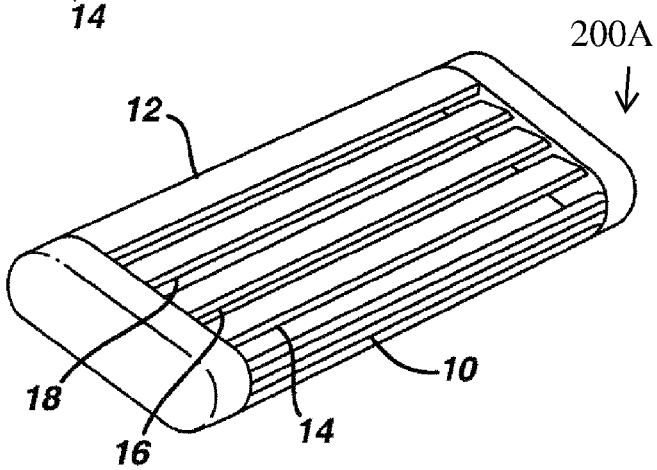
Figure 3B:
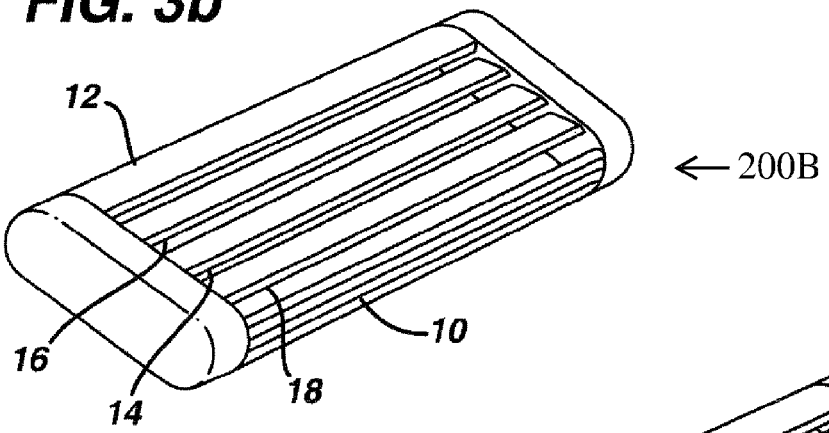

Referring to FIGS. 3*a-b*, 4, and 5*a-c*, other razors can include the guard 10, the cap 12, and the multiple blades 14, 16 (three, four, or five blades respectively). In each instance a first blade 14 having higher cutter forces than a second blade 16 is positioned between a guard 10 and the second blade 16. As depicted in FIGS. 3*a* and 3*b*, where the razor has three blades, the first blade 14 can be the blade closest to the guard (i.e., in the principal position) (FIG. 3*a*), or it can be positioned after the principal position, where the third blade 18 is in the principal position (FIG. 3*b*). The third blade can have any desired cutter force, typically within a 0.8 to 1.5 pound range.

Although FIGS. 3*a* and 3*b* both depict razor cartridges 200A and 200B, respectively, where the first and second blades 14 and 16 are positioned adjacent to each other, other instances are envisioned where the first and second blade 14 and 16 are not positioned adjacent to each other. For example, in some instances (not shown) the first blade 14 is positioned nearest the guard 10 with the third blade 18 positioned between the first and second blade 14 and 16. In general, any positioning of the multiple blades is acceptable provided that the first blade 14 is positioned closer to the guard than the second blade 16.

Figure 4:
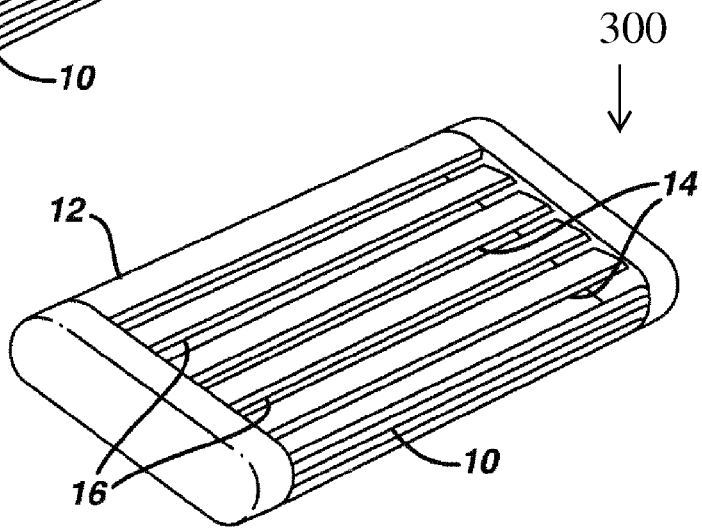

As depicted in FIG. 4, the razor cartridge 300 can include four blades. FIG. 4 depicts a razor cartridge 300 having two first blades 14 with higher cutter forces and two second blades 16 having lower cutter forces. The first blades 14 with higher cutter forces are positioned to alternate with the second blades 16 having lower cutter forces. The first blades 14 having the higher cutter forces are positioned closest to the guard 10 (i.e., the principal position) and in the third position from the guard 10. The second blades 16 having lower cutter forces are positioned in the second and fourth positions from the guard 10.

Figure 5A:
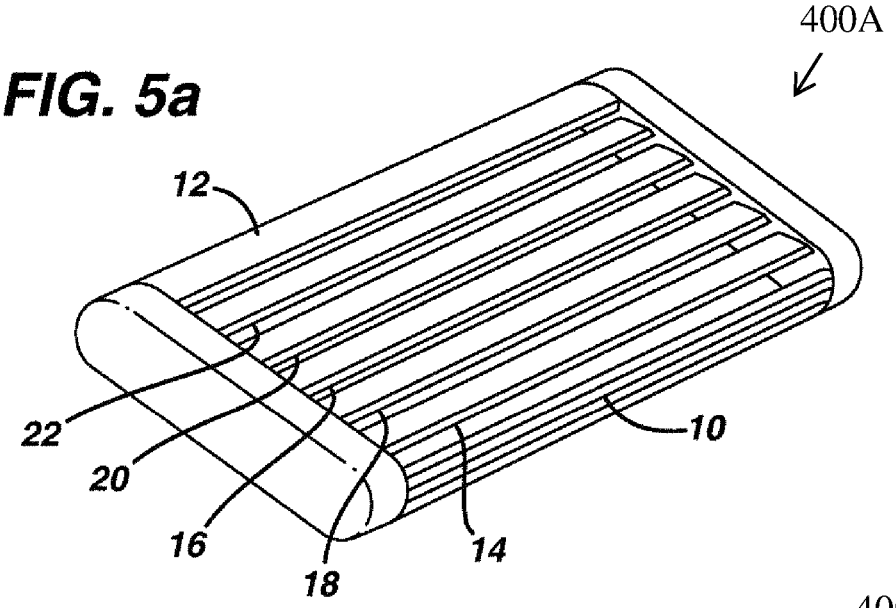
Figure 5B:
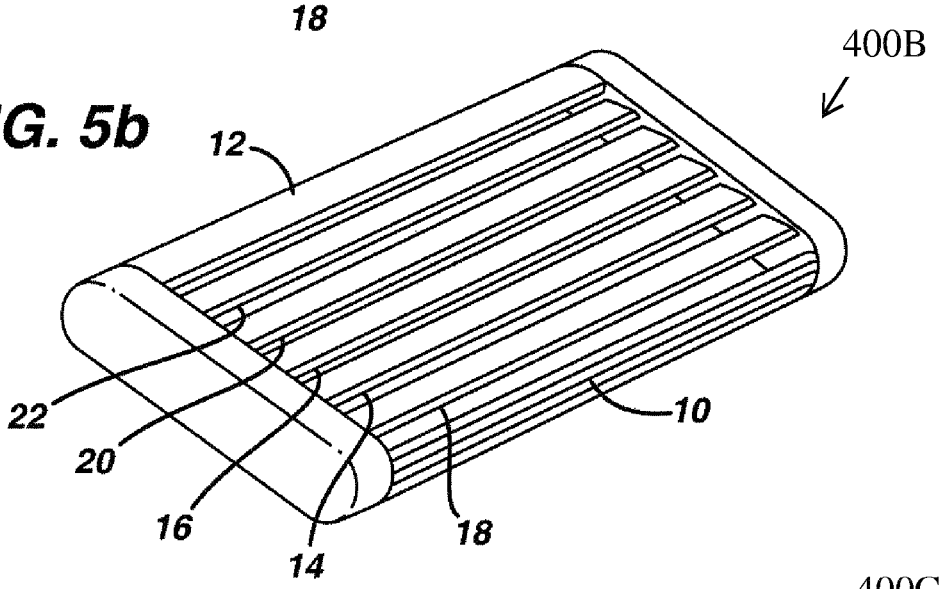
Figure 5C:
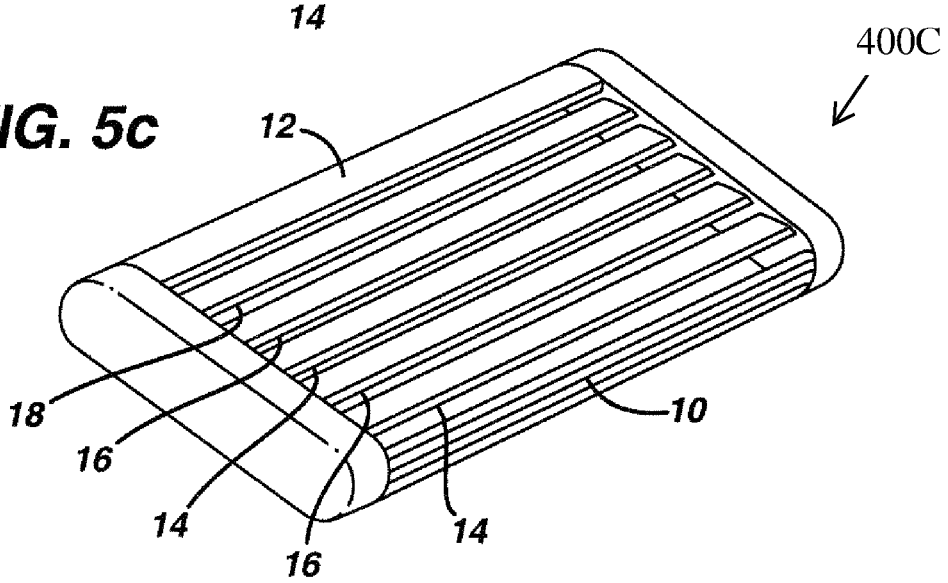

FIGS. 5*a*-5*c* all depict razor cartridges 400A-C, respectively, each razor cartridge 400A-C having five blades. In these razor cartridges 400A-C, the position of the first and second blades 14 and 16 is varied. In FIG. 5*a*, the first blade 14 is in the principal position and the second blade 16 is in the third position from the guard 10. The razor cartridge 400A also includes three additional blades 18, 20, and 22. Typically, these blades will have cutter forces less than 1.6 pounds, e.g., in the range of 0.8 to 1.5 pounds.

FIG. 5*b* depicts an example of a razor cartridge 400B in which the first blade 14 is not in the principal position, but instead is in the second position from the guard 10. The second blade 16 is positioned directly behind the first blade, in the third position. Like FIG. 5*a*, the razor cartridge 400B also includes additional blades 18, 20, and 22. FIG. 5*c* depicts a razor cartridge 400C having two first blades 14 and two second blades 16. The razor cartridge 400C also includes a blade 18 in the position nearest the cap 12.

In some instances, the first blade has a cutter force at least about 0.1 lbs greater than the cutter force of the second blade. In general, the cutter force of the first blade is between about 0.1 and 1.0 lbs. (e.g., at least about 0.2, 0.3, 0.4, or 0.5 lbs. and at most about 1.0, 0.9, 0.8, 0.7 and 0.6 lbs.) greater than that of the second blade. Preferably, the first blade 14 has a higher cutter force of about 0.2 lbs. relative to the second blade 16.

Providing a blade having higher cutter forces can be accomplished in a variety of ways. In some instances, it is desirable to provide a first blade having a modified polymer coating. For example, the blade may include a Teflon coating that is modified, for example using plasma etching, to incrementally increase its surface friction. Exposure of the coated blade to plasma under suitable conditions can cause both chemical and physical changes to occur on the polymer coating. The changes can affect a variety of properties of the coating, including but not limited to roughness, wettability, cross-linking, and molecular weight, each of which can affect the cutter force of the blade.

In some instances, a blade can be used that is substantially free of polymer coating. However, a blade without any polymer coating can result in an undesirable decrease in comfort. For example, it may pull the hair too aggressively.

Polymer Coating a Blade

Methods of coating razor blade edges with polyfluorocarbons are known in the art and are disclosed, for example, in U.S. Pat. No. 5,263,256 to Trankiem. A polyfluorocarbon-coated blade edge can be prepared by any process known in the art. For example, the blade edge can be coated with a polyfluorocarbon dispersion.

Examples of polyfluorocarbons include MP1100, MP1200, MP1600, and LW1200 brand polytetrafluoroethylene powders manufactured by DuPont.

Polyfluorocarbon dispersions generally include from 0.05 to 5% (wt) polyfluorocarbon, preferably from 0.7 to 1.2%

(wt), dispersed in a dispersant media. The polymer can be introduced into a flow stream or mixed directly into an agitated reservoir and then homogenized. When injected into the flow stream, a static mixer downstream is generally used.

The dispersing medium generally includes one or more of a fluorocarbon (e.g. Freon brand from DuPont), water, a volatile organic compound (e.g. isopropyl alcohol), and/or supercritical $CO_2$.

The dispersion can be applied to the cutting edge in any suitable manner, as for example, by dipping or spraying the dispersion onto the blade edge. Where nebulization is used, an electrostatic field can be employed in conjunction with the nebulizer in order to increase the efficiency of deposition. The coating is generally heated upon application to provide improved adhesion.

The coated blade is then heated to drive off the dispersing media and sinter the polyfluorocarbon onto the blade edge. Alternatively, the blade can be coated using chemical vapor deposition, laser, or sputtering deposition.

Modifying the Blade Coating

Low surface friction and hard to wet materials, such as Teflon, can be modified, for example, using plasmas to incrementally increase surface friction. Examples of plasmas include, for example radiofrequency (RF) plasma or direct current (DC) plasma. Exposure of the coated blade to plasma under suitable conditions can cause both chemical and physical changes to occur on the polymer coating. The changes can affect a variety of properties (e.g., polymer properties) including but not limited to roughness, wettability, cross-linking, and molecular weight, each of which can affect the cutter forces of the blade.

Figure 6:
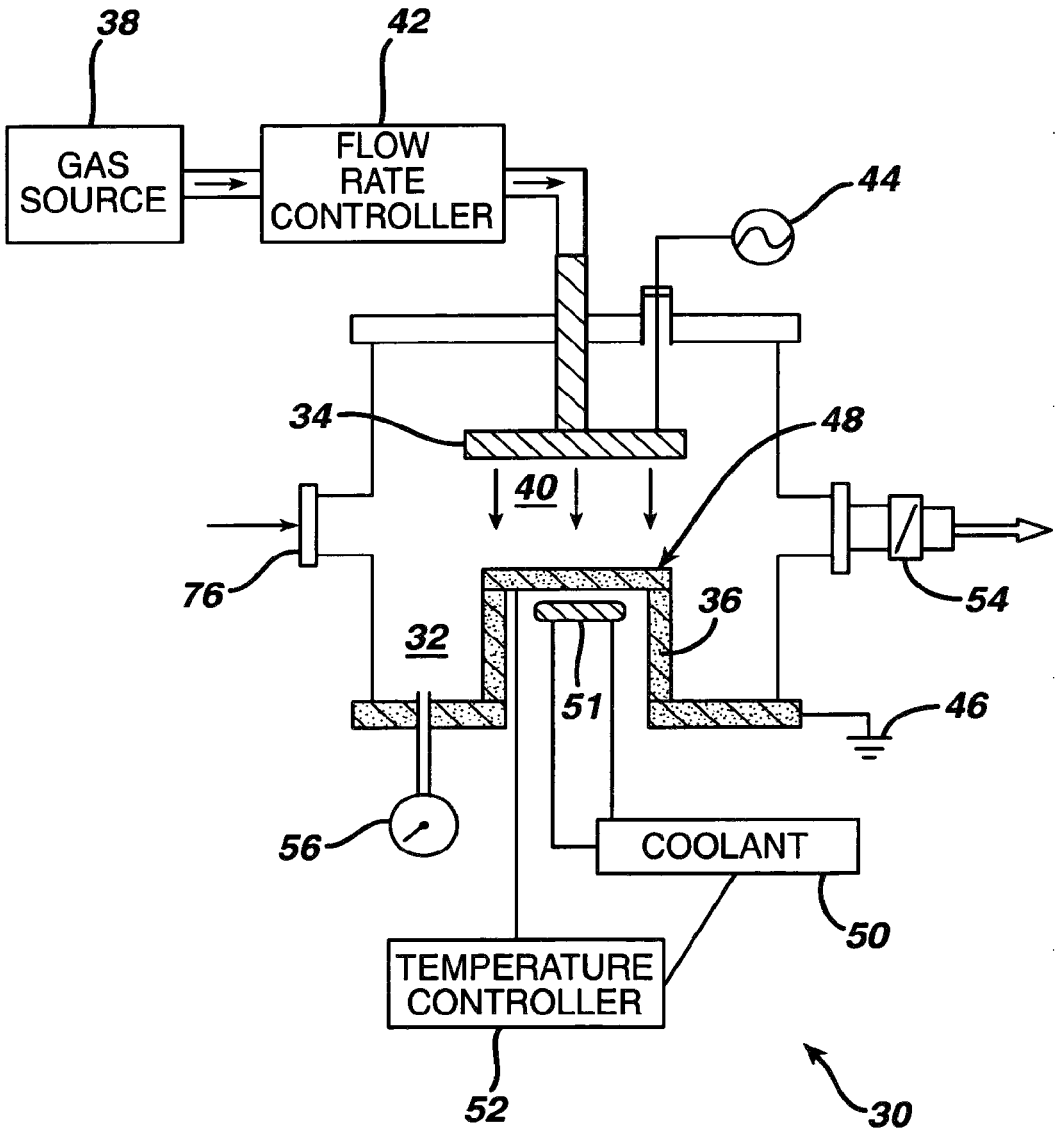
FIG. 6 depicts a schematic of a plasma formation process.

An RF plasma deposition system like that schematically illustrated in FIG. 6 can be employed for carrying out the modification process. As will be recognized by those skilled in the art, other conventional plasma systems can also be employed. The example system 30 includes an air-tight vacuum chamber 32 formed of, e.g., steel, and includes a powered electrode 34 and a ground electrode 36 each formed of, e.g., aluminum.

The powered electrode 34 is preferably configured with connection to a feed gas source 38 such that the gas 40 is introduced into the chamber, e.g., through tubes in the powered electrode in a conventional shower-head configuration. Preferably, the shower-head tubes provide a reasonably equal flow of gas per unit area of the upper electrode. Accordingly, the shower-head tubes should be spaced such that the concentration of the gas injected out of the shower-head is relatively uniform. The number and spacing of the tubes is dependent upon the specific pressure, electrode gap spacing, temperature, and other process parameters, as will be recognized by those skilled in the art.

A flow rate controller 42 is preferably provided to enable control of the flow of gas through the powered electrode into the chamber. The powered electrode is also connected electrically to a radio frequency (RF) power source 44, or other suitable power source, for producing a plasma of the feed gas in the chamber.

The grounded electrode 36 is connected electrically to a ground 46 of the vacuum chamber system. Preferably, the grounded electrode 36 provides a surface 48 for supporting a substrate or other structure. The grounded electrode and its support surface are preferably cooled by way of a cooling system including, e.g., a coolant loop 50 connected to cooling coils 51 and a temperature controller 52, enabling a user to set and maintain a desired electrode temperature by way of, e.g., water cooling.

A pump 54 is provided for evacuating the chamber to a desired pressure; the pressure of the chamber is monitored by way of, e.g., a pressure gauge 56. Also preferably provided is an analysis port 76 for enabling a user to monitor progress of the process.

Suitable gasses to provide plasma include, for example, oxygen, argon, nitrogen, and a variety of fluorocarbons. Varying the type of gas, the plasma power, the gas pressure and the geometry of the blades can affect the degree and kind of modification to the blade or polymer coating. Accordingly, it is possible to provide blades having a range of different frictional properties (i.e., cutter forces).

Plasma, for example, high ion bombardment plasma, e.g., RF or DC plasma, can selectively remove polymer, for example, at the tip of the blade. Accordingly, where a blade is coated with a polymer, the blade, or a portion of the blade, can be exposed to a plasma (e.g., argon, oxygen, or a mixture thereof) that will physically etch away a portion of that polymer. In general, the composition of the plasma (e.g., reactivity of the elements) can be varied depending on the desired result of the exposure to the plasma. For example, where the polymer is being etched to physically modify the polymer, a mixture of argon and oxygen is generally preferred (e.g., a 90/10 mixture of argon/oxygen). The higher the oxygen content, the faster the etching rate will be. Other suitable gases include neon and nitrogen.

Figure 7A:
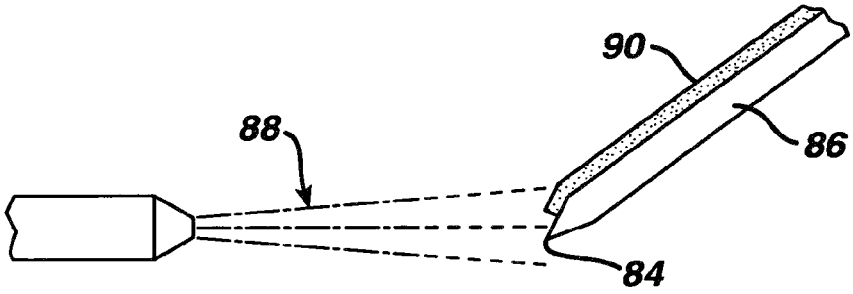
FIGS. 7*a* and 7*b* depict modification of a portion of a blade using plasma.
Figure 7B:
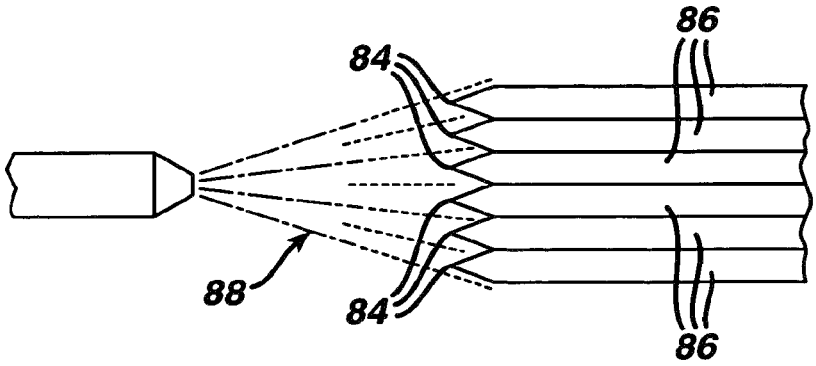

In some instances, referring to FIGS. 7*a* and 7*b*, only the tip 84 of the blade 86 is etched with plasma 88. Selectively etching only a portion of the blade 86 can be accomplished in a variety of ways. For example, using a mask 90 to cover a portion of the blade 86 that is not modified (See FIG. 7*a*.), or placing blades 86 in the stream of the plasma 88 with a geometry that favors exposure of a only portion of the blade, for example the tip 84 of the blade 88 (See FIG. 7*b*.), provides selective exposure of a desired portion of the blade 86.

In instances where a coated blade is exposed to plasma, the plasma can etch away the entire thickness of the polymer, providing portions of the blade (e.g., the blade tip) that are substantially free of polymer coating. Alternatively, the plasma can instead etch only a portion of the thickness of the polymer to thin or change the texture of the polymer coating. For example, the polymer coated blade can be exposed to plasma under conditions to provide a coating having a rough texture, which can increase the cutter forces of the blade.

In general, a physical modification of a coated blade can be accomplished by exposing the coated blade to plasma for between 5 seconds and about 10 minutes (e.g., between about 1 and 8 minutes, preferably about 5 minutes). The pressure is generally between about 1 and about 100 mtorr (e.g., between about 10 and about 75 mtorr, preferably between about 20 and about 40 mtorr). In general, the plasma is supplied at an energy between about 1 and about 100 Watts (e.g., between about 5 and about 80 Watts, between about 10 and about 50 Watts, or about 20 Watts).

Figure 8:
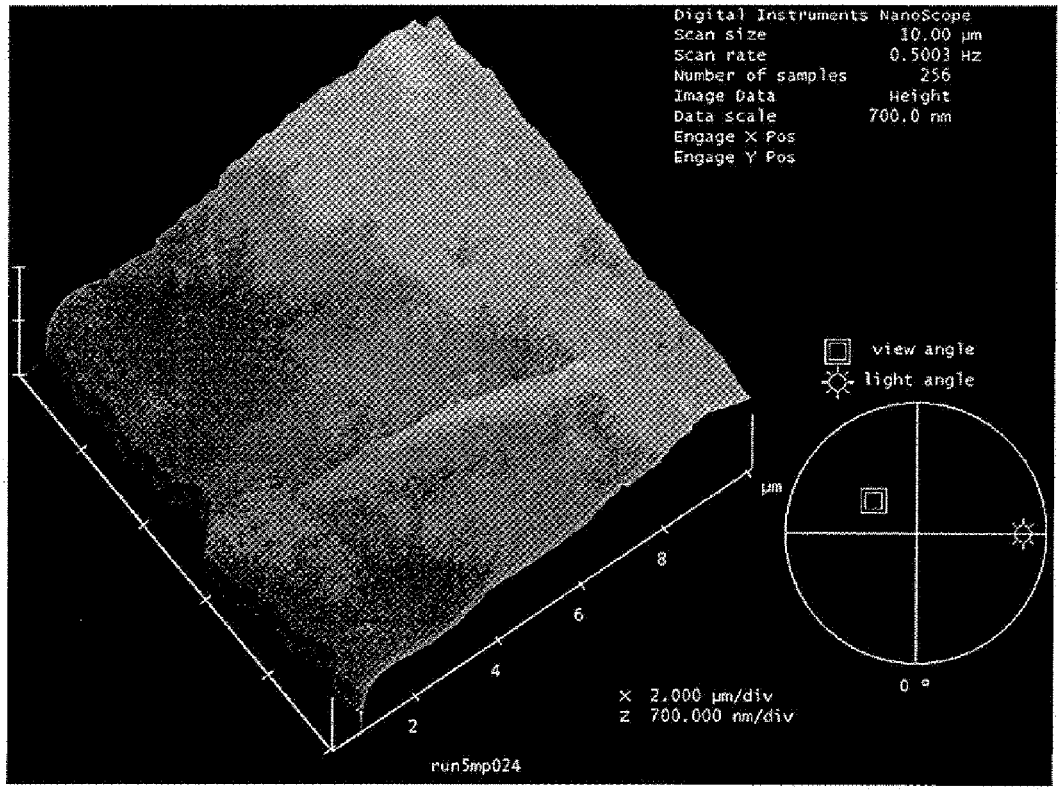
FIG. 8 depicts an atomic force microscope (AFM) image of a blade tip etched with plasma.

An example of a blade tip 84 etched with plasma is depicted in FIG. 8. The blade was coated with MP 1600 polymer and exposed to plasma of 90% Ar/10% $O_2$ for 5 minutes at 20 W and a pressure between 20 and 40 mtorr. Upon exposure, about 3 μm of the polymer was removed from the tip to provide a tip portion of the blade substantially free of polymer coating.

While in some instances a coated blade can be exposed to plasma to remove, thin, or roughen the polymer coating, in other instances the coated blade can be exposed to plasma to chemically modify the polymer coating. For example, where it is desirable to increase the cutter forces of the blade, the polymer coating can be exposed to a plasma that will reduce the lubricity of the polymer coating, for example by reducing the degree of fluorination of a polymer, e.g., a PTFE polymer. RF or DC plasma may be used, and exposure time can range from a few seconds to 20 minutes.

In general, for chemical modification of the coated blade, the plasma is provided at a pressure of between about 1 and about 100 mtorr, (e.g., at least about 1, 5, 10, 15, 20, 25, 30, or 40 mtorr and at most about 100, 95, 90, 85, 80, 75, 50, or 40 mtorr). Although the conditions of plasma exposure can vary depending on the nature of the desired modification (e.g., plasma etching or plasma deposition), in general, the blades are exposed to plasma for between about 5 seconds and about 30 minutes (e.g., about 15 seconds, 30 seconds, 1 minute, 2 minutes, 50 minutes, 10 minutes, etc.). The plasma is generally provided at between about 1 and about 100 W (e.g., about 5, 10, 15, 20, 25, 30, 40, 45, 50, 60, 70, 80, 90, or 100 W). Preferably, the base vacuum (pressure prior to deposition) is greater than $10^{-6}$ Torr, and during deposition is at least $10^{-3}$ Torr. It is also preferred that heating be limited to less than the melting temperature of the polymer, typically less than 300° C. The preferred conditions will vary depending on the gas used.

Applying a Blade Coating Using Plasma

In some instances a blade not coated with polymer is exposed to a plasma that deposits a coating thereon. For example, an uncoated blade having high cutter forces can be modified to have lower cutter forces by using plasma to deposit a fluorine containing moiety (e.g., a $CF_2$ species) directly onto the blade (e.g., onto a hard coating such as diamond like carbon). The use of plasma deposition, e.g., high ion bombardment plasma, can provide blades having different physical properties than those coated with a polymer (e.g., a PTFE polymer) using the methods described above.

Preferably, the monomer gas includes hexafluoropropylene oxide, and the heat source preferably is a resistively-heated conducting filament suspended over the structure surface or a heated plate having a pyrolysis surface that faces the structure. The heat source temperature is preferably greater than about 500 K and the structure surface is preferably substantially maintained at a temperature less than about 300 K. Where it is desirable to have a blade with higher cutter forces than a polymer coated blade, the blade can be exposed to a $CF_2$ containing plasma for a time sufficient to lower the cutter forces relative to the uncoated blade while still having higher cutter forces than a polymer coated blade.

The conditions of plasma exposure can vary depending upon the desired blade properties. For example, the blade can be exposed for a greater length of time if a higher amount of plasma deposition is desired. In general, deposition of a film having properties similar to bulk PTFE can be accomplished with the described methods.

A number of embodiments of the invention have been described. Nevertheless, it will be understood that various modifications may be made without departing from the spirit and scope of the invention.

For example, while modification of the blades using plasma has been described, other blade modification methods are also envisioned. In some instances a polymer coated blade is exposed to electric current to chemically and physically modify the blade surface. In some instances the polymer coating is exposed to a laser or electron beam to chemically and physically modify the blade surface.

In some instances a blade (e.g., a polymer coated blade) is subjected to additional modifications, for example a blade can be exposed to a solvent to modify the amount or thickness of polymer coating on the blade. The additional modification can occur, for example, either before the blade is exposed to plasma, laser, or electric current, or after the blade is exposed to plasma, laser, or electric current.

Accordingly, other embodiments are within the scope of the following claims.

What is claimed is:

1. A method of making a razor comprising a safety razor blade unit comprising a guard, a cap, and at least two blades having parallel sharpened edges located between the guard and cap, the at least two blades including a first blade and a second blade, the first blade defining the sharpened edge thereof nearer the guard than the second blade and the second blade defining the sharpened edge thereof nearer the cap than the first blade, the method comprising;

coating the first blade including the sharpened edge thereof with a polymer coating; and coating the second blade including the sharpened edge thereof with a different configuration of polymer coating to provide the second blade with a lower frictional resistance hair cutter force than the first blade.

2. The method of claim 1, wherein the polymer coating of the first blade is less lubricious than the polymer coating of the second blade.

3. The method of claim 1, wherein the first and second blades are each coated with an amount of their respective polymer coatings such that the amount of polymer coating on the second blade is greater than the amount of polymer coating on the first blade.

4. The method of claim 1 further comprising exposing the polymer coating of the first blade to at least one of plasma, electric current, or an electron beam to modify at least a portion of the polymer coating of the first blade.

5. The method of claim 4, wherein the plasma comprises radiofrequency plasma.

6. The method of claim 4, wherein the plasma comprises direct current plasma.

7. The method of claim 4, wherein the plasma comprises at least one of oxygen, argon, nitrogen, fluorine, or a fluorocarbon.

8. The method of claim 4, wherein the plasma comprises argon.

9. The method of claim 4, wherein the plasma comprises a mixture of argon and oxygen.

10. The method of claim 9, wherein the plasma comprises a mixture of about 90% argon and about 10% oxygen.

11. The method of claim 4 further comprising treating the first blade with a solvent.

12. The method of claim 11, wherein the first blade is treated with the solvent before exposing the first blade to plasma, laser, or electric current.

13. The method of claim 11, wherein the first blade is treated with the solvent after exposing the first blade to plasma, laser, or electric current.

14. The method of claim 1, wherein said coating the first blade or said coating the second blade comprises spraying the respective polymer coating on the corresponding one of the first blade or the second blade and sintering said corresponding one of the first blade or the second blade.

15. The method of claim 1, wherein said coating the first blade or said coating the second blade comprises chemical vapor deposition, or laser or sputtering deposition.

* * * * *